US006783407B2

(12) United States Patent
Wu

(10) Patent No.: US 6,783,407 B2
(45) Date of Patent: Aug. 31, 2004

(54) LOW INSERTION FORCE ELECTRICAL CONNECTOR ASSEMBLY

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/355,561

(22) Filed: Jan. 31, 2003

(65) Prior Publication Data

US 2004/0152371 A1 Aug. 5, 2004

(51) Int. Cl.[7] ..... H01R 4/48
(52) U.S. Cl. ..... 439/834
(58) Field of Search ..... 439/834, 835, 439/441, 595, 596, 733.1, 290, 291, 862, 660

(56) References Cited

U.S. PATENT DOCUMENTS

| | | | | |
|---|---|---|---|---|
| 3,833,879 A | | 9/1974 | Aidn et al. | |
| 4,175,821 A | | 11/1979 | Hunter | |
| 4,607,907 A | | 8/1986 | Bogursky | |
| 4,735,588 A | | 4/1988 | Bird et al. | |
| 4,740,180 A | | 4/1988 | Harwath et al. | |
| 4,941,853 A | | 7/1990 | Harwath | |
| 5,290,181 A | | 3/1994 | Bixler et al. | |
| 5,558,542 A | | 9/1996 | O'Sullivan et al. | |
| 5,667,411 A | | 9/1997 | O'Sullivan et al. | |
| 5,692,928 A | | 12/1997 | Nelson et al. | |
| 5,807,142 A | | 9/1998 | O'Sullivan | |
| 6,290,548 B1 | | 9/2001 | Yeh | |
| 6,488,541 B1 | * | 12/2002 | Takeuchi | 439/660 |
| 6,527,592 B2 | * | 3/2003 | Mochizuki et al. | 439/660 |

FOREIGN PATENT DOCUMENTS

| | | |
|---|---|---|
| TW | 454995 | 9/2001 |
| TW | 484754 | 4/2002 |

* cited by examiner

*Primary Examiner*—Tho D. Ta
*Assistant Examiner*—Ann McCamey
(74) *Attorney, Agent, or Firm*—Wei Te Chung

(57) ABSTRACT

An electrical connector assembly (1) includes a plug connector (2) and a receptical connector (3). The plug connector includes an insulative housing (20) having a number of passageways (205) and a number of fingers (206), and a number of electrical contacts (22) received in the passageways and supported by the fingers. The receptacle connector has an insulative housing (30) defining a number of grooves (306) and a number of electrical contacts (32) formed with slanted resilient arms (322) extending in the grooves. The resilient arms guide the fingers to extend into the grooves to establish an electrical connection between the electrical contacts on the fingers and the resilient arms with a low insertion force.

12 Claims, 13 Drawing Sheets

LOW INSERTION FORCE ELECTRICAL CONNECTOR ASSEMBLY

BACKGROUND OF THE INVENTION

1. Field of the Invention

The present invention relates to an electrical connector assembly, and particularly to an electrical connector assembly comprising a plug connector and a receptacle connector matable with the plug connector.

2. Description of the Prior Art

Various single and dual spring arm female electrical terminals have been provided in the past for making electrical contact with male terminals such as pins, blades, edge card contact pads and the like. Generally, in these arrangements, the male terminal must be inserted into the female terminal with sufficient force to overcome the resistance to insertion presented by the female terminal. The insertion force of the contact structure includes a lifting component which represents the force required to lift or spread the female contact portions apart to permit passage of the male terminal into the female terminal and also a horizontal frictional component provided as the female contact portions wipe against the male terminal during the insertion.

In multicircuit arrangements including a large number of female terminals mounted in a connector adapted to mate with a male connector including a correspondingly large number of male terminals, the individual insertion forces associated with each pair of contacts combine so that the overall insertion force required to mate the male and the female connectors can be extremely large.

Earlier efforts to provide an electrical contact structure characterized by reduced insertion force have generally included modifying the female terminal contacts. In U.S. Pat. No. 4,175,821, for example, a female terminal is disclosed including a dual opposed spring arm contact member wherein the contact portions of the opposed arms are axially offset from one another in the longitudinal direction. As the pin contact is inserted between the female spring arms, the pin engages the first spring arm on the female terminal and lifts it out of the way, before contacting the second spring arm and moving that contact out of the way. A lower peak insertion force is provided by the arrangement because the lifting force needed to deflect the female terminal to a final mated position is broken down into two smaller lifting steps, lifting one spring arm at a time during the insertion stroke instead of two at a time.

The design described in the patent has several shortcomings. For example, the female terminal is adapted to receive a conventional square pin male terminal which includes a relatively short, chambered tip portion. The tip portion of the male terminal typically is a rough machine surface which wipes against the precious metal plated contact portion on the female terminal. Repeated mating results in abraded contacts which tends to make the contact arrangement electrically unreliable in prolonged use. Increasing the precious metal plating in the contact area results in increased cost which is also undesirable.

Another modified low insertion force female terminal is disclosed in U.S. Pat. No. 4,607,907. The female contact in this patent is a stamped and formed terminal including a rearward box member from which extend cantilevered spring arms including contact portions at their free ends. The contact portions are axially longitudinally offset as were the contact portions in the aforementioned patent, but in addition, they are configured so that overshoot the midline of the insertion region which permits lower spring rates to be used. The female contact further includes a horizontal spacing between the cantilevered spring arms so that the contact portions are horizontally spaced one from the other. This permits the contact portions to be plated with precious metals in a lower cost process. This female contact provides a lower peak insertion force for the same reasons, i.e. the male lifts one cantilevered spring arm at a time during insertion. The overshot design of the contact portions permits lower spring rates in the spring members to be used, so that the stiffness of each spring member is reduced and the force required to lift each spring arm contact during pin insertion is reduced.

This design also possesses several shortcomings. As with the first mentioned female, the rough cut abrasive edge of the chambered lead-in on the male pin scrapes against the precious metal coated contact portions of the spring arms during pins insertion. Long term electrical reliability in repeated mating operations is generally not obtained. The female terminal is stamped and then formed in a manner which produces a significantly large amount of wasted sheet metal stock. Furthermore, because these female terminals are formed after stamping to provide the box portion and opposed spring arm structure, they cannot be provided on a carrier strip spaced apart by center line spacings adapted for ready insertion in a connector housing in a single stamping operation. Instead, after they are formed, they must be repositioned to a spacing appropriate for insertion into a housing. This requires additional manufacturing and assembly steps in use.

Another approach to providing a low insertion force contact is disclosed in U.S. Pat. No. 4,735,588. The mating electrical contact structure described therein includes an electrically conductive elongated tubular female receptacle contact having at least one resilient elongated beam. Either the female tubular receptacle or the male terminal includes a predefined longitudinally extending rotational skew or twist profile. As the male terminal is inserted into the female receptacle, the resilient beam on the male terminal is progressively deflected along the predefined rotational skew. In accordance with the design, the rotational deflection provides a torque which generates the mated contact force between the male and female contacts. The degree of the rotational skew in this contact arrangement determines the amount of progressive deflection during insertion.

This design also has some shortcomings. The male terminal member in at least one embodiment must be assembled and the additional assembly steps add to the cost of the contact structure. Another disadvantage in manufacturing is encountered because the interior of the tubular female member is extremely difficult to plate with precious metals satisfactorily after it is formed. The opposed inner surfaces will create field effect interference in plating operations, resulting in poor or lower quality plating. Moreover, the contact design structure is very sensitive to misalignment of the mating female and male terminals. If the male terminal member is positioned to be slightly offset from the central axis of the tubular female, the low insertion force characteristics can be changed into very high insertion forces because a misalignment will tend to deflect or try to deflect nonresilient members in the system.

U.S. Pat. No. 4,740,180 discloses a low insertion force mating electrical contact structure which includes a male terminal having a twisted lead-in portion with at least one surface adapted to engage at least one contact of a female terminal. During insertion the twisted lead-in portion of the male terminal is effective to gradually cam outwardly contact portions of a pair of spring arms of the female terminal from an initial position to a final mated position to provide a lower overall insertion force and at the same time provide a high contact normal force between the female and the male terminals. The mating electrical contact structure and camming profile disclosed in this patent have proven effective to provide a highly reliable, lower insertion force contact interface. However, the design is not easily adaptable for miniaturization beyond a certain point, i.e., for reducing individual terminal size in order to produce denser arrays of terminal size in order to produce denser arrays of terminals in increasingly smaller packages. Furthermore, the solid lead-in portion of the male terminal has limited mating depth and does not generally permit applications in which sequential or staggered mating may be required. They may provide potential problems in some specific connector applications.

Therefore, an electrical connector assembly with improved low insertion force structure is desired to overcome the disadvantages of the prior art.

SUMMARY OF THE INVENTION

A first object of the present invention is to provide an electrical connector assembly comprising a plug connector and a receptacle connector matable with the plug connector with a low insertion force.

A second object of the present invention is to provide an electrical connector assembly having a reliable electrical connection between a plug connector thereof and a receptacle connector thereof with a reduced cost.

A third object of the present invention is to provide an electrical connector assembly manufactured with a simplified process and without dimension limitation.

An electrical connector assembly in accordance with the present invention comprises a plug connector and a receptacle connector matable with the plug connector. The plug connector comprises an insulative housing and a plurality of electrical contacts. The insulative housing comprises a base portion defining a plurality of passageways, a mating portion extending from the base portion and defining a receiving cavity in communication with the passageways, and a plurality of fingers extending from the base portion into the receiving cavity. The electrical contacts extend through the passageways into the receiving cavity to be supported by the fingers.

The receptacle connector comprises an insulative housing and a plurality of electrical contacts. The insulative housing comprises a base portion defining a plurality of passageways and a mating portion defining a plurality of grooves extending therethrough and communicating with corresponding passageways. Each electrical contact comprises a slanted resilient arm. Every two electrical contacts are inserted from each groove through one corresponding passageway with the resilient arms thereof resiliently extending in the groove. The resilient arms and the fingers are configured in such a way that the fingers extend into the grooves to establish an electrical connection between the electrical contacts on the fingers and the resilient arms when the mating portion of the receptacle connector is plugged into the mating portion of the plug connector with a low insertion force.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
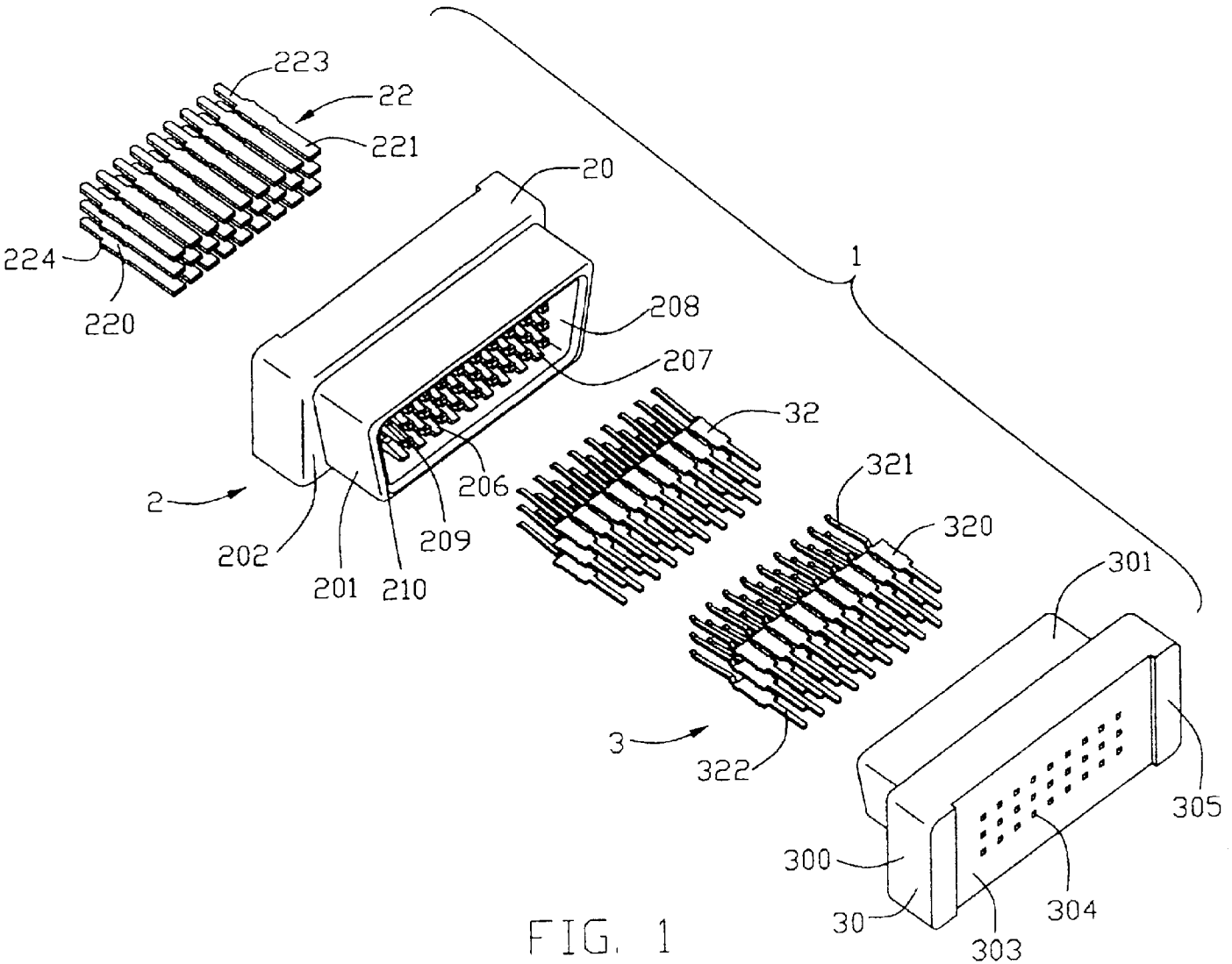
FIG. 1 is an exploded view of an electrical connector assembly in accordance with the present invention.
Figure 2:
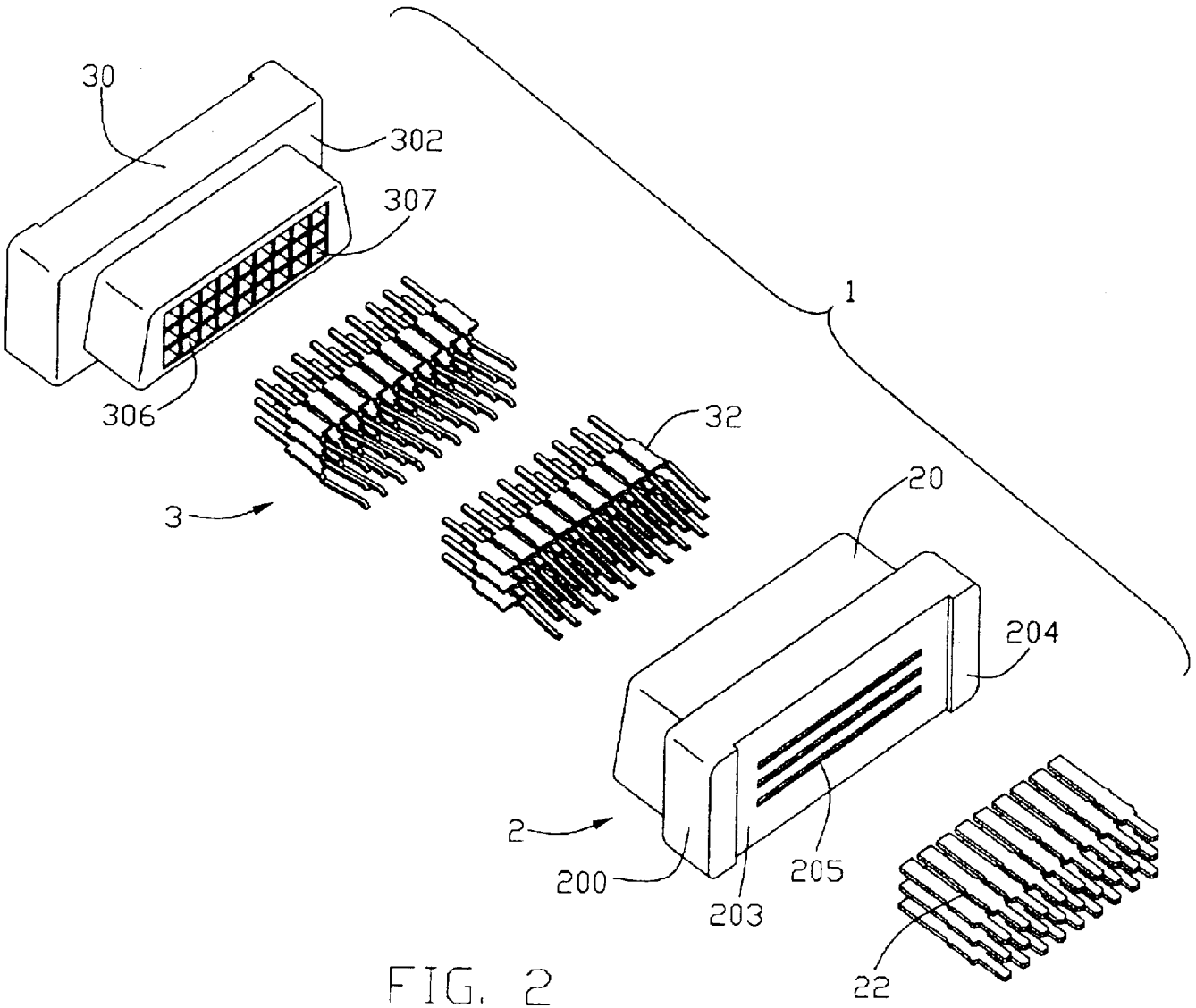
FIG. 2 is a view similar to FIG. 1 but taken from a different perspective.

Referring to FIGS. 1 to 2, an electrical connector assembly 1 in accordance with the present invention comprises a plug connector 2 and a receptacle connector 3 matable with the plug connector 2.

Figure 14:
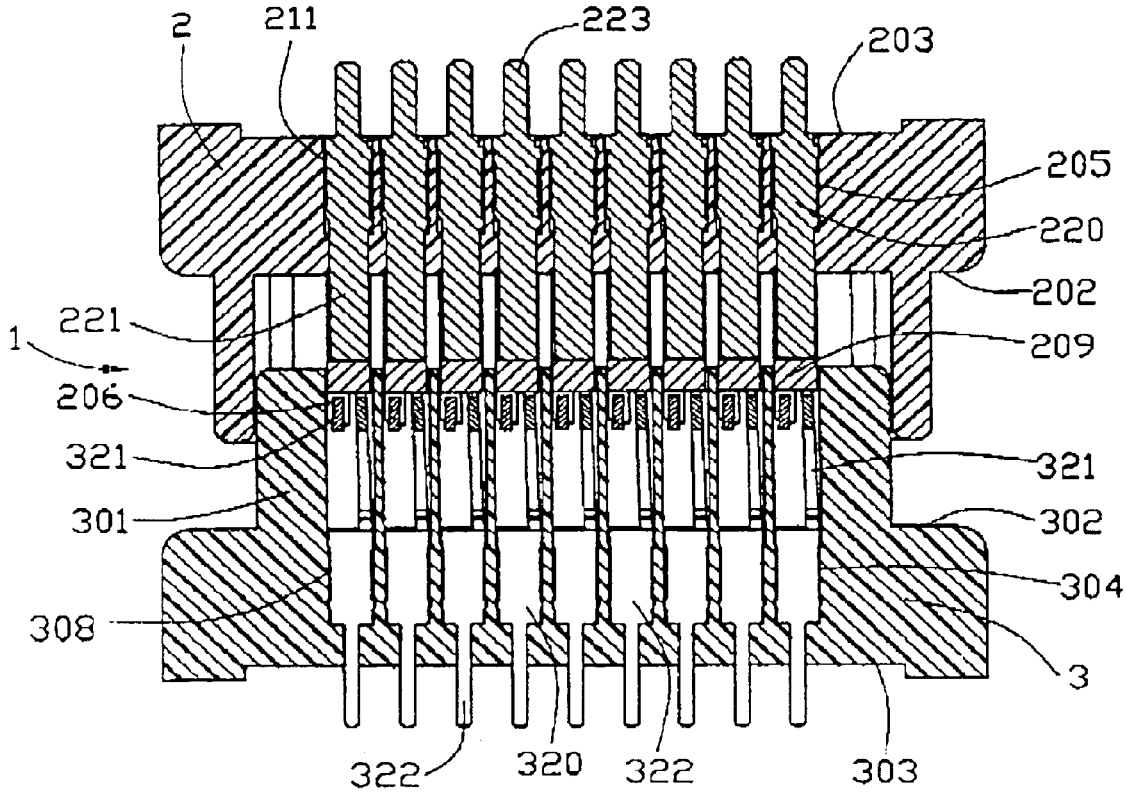
FIG. 14 is a cross-sectional view taken along line 14—14 of FIG. 10.
Figure 15:
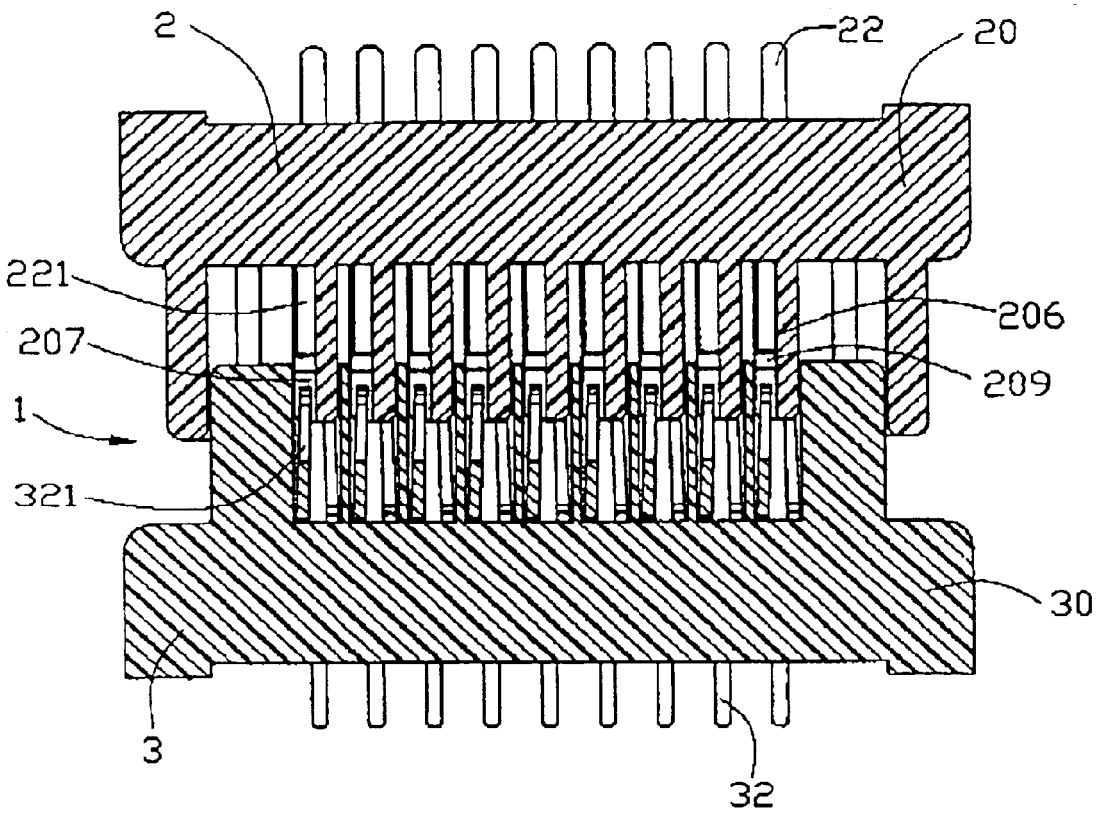
FIG. 15 is a cross-sectional view taken along line 15—15 of FIG. 10.
Figure 16:
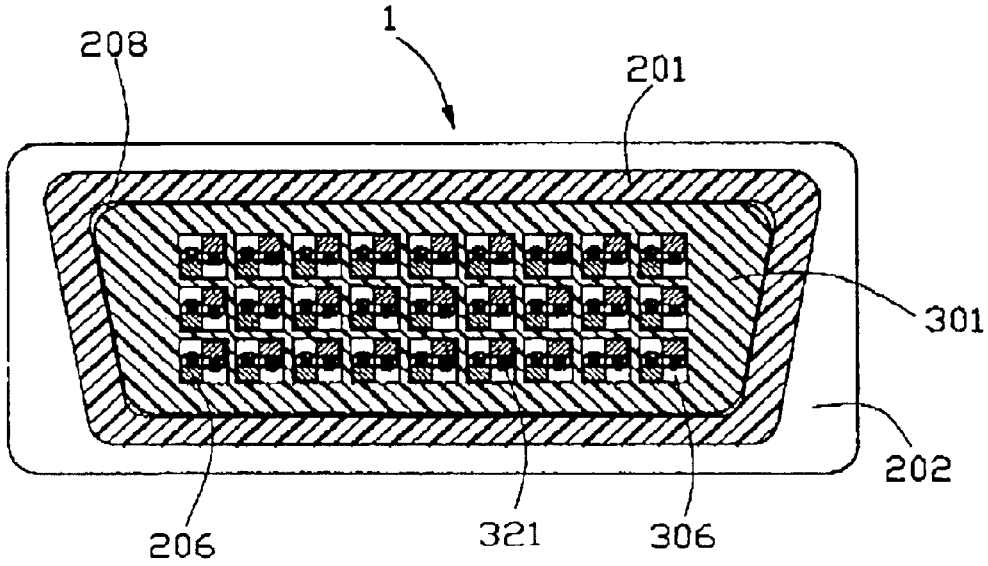
FIG. 16 is a cross-sectional view taken along line 16—16 of FIG. 9.
Figure 17:
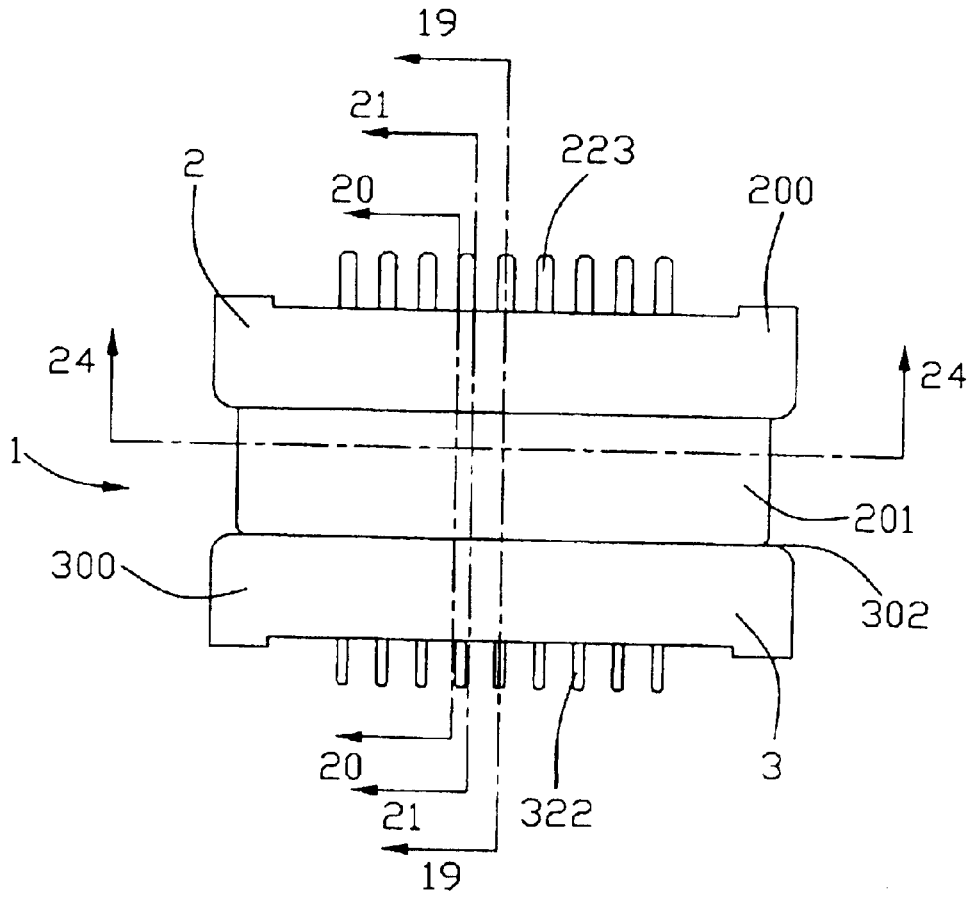
FIG. 17 is a view similar to FIG. 9 but the plug and the receptacle connectors have been completely mated with each other.
Figure 18:
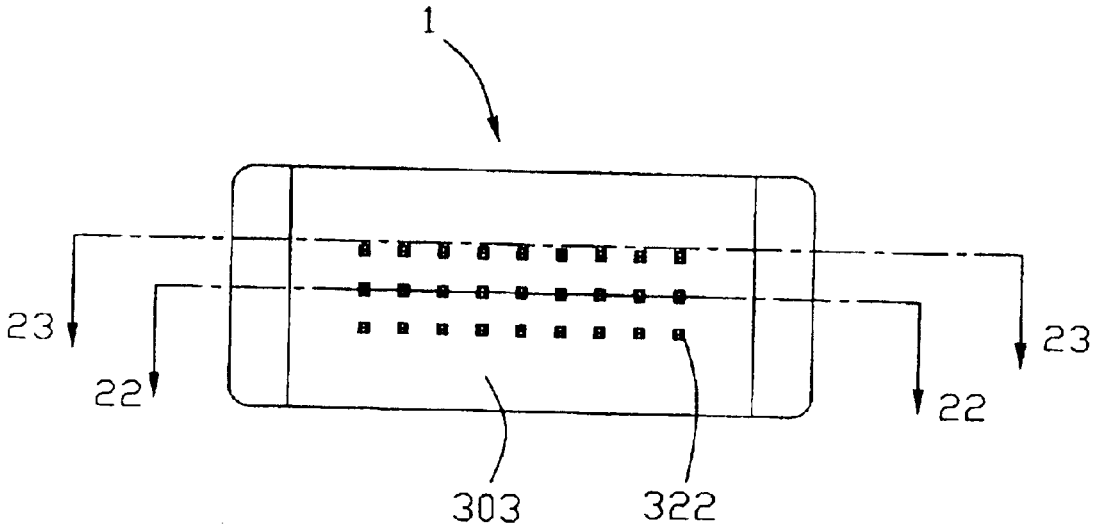
FIG. 18 is a front elevational view of FIG. 17.
Figure 19:
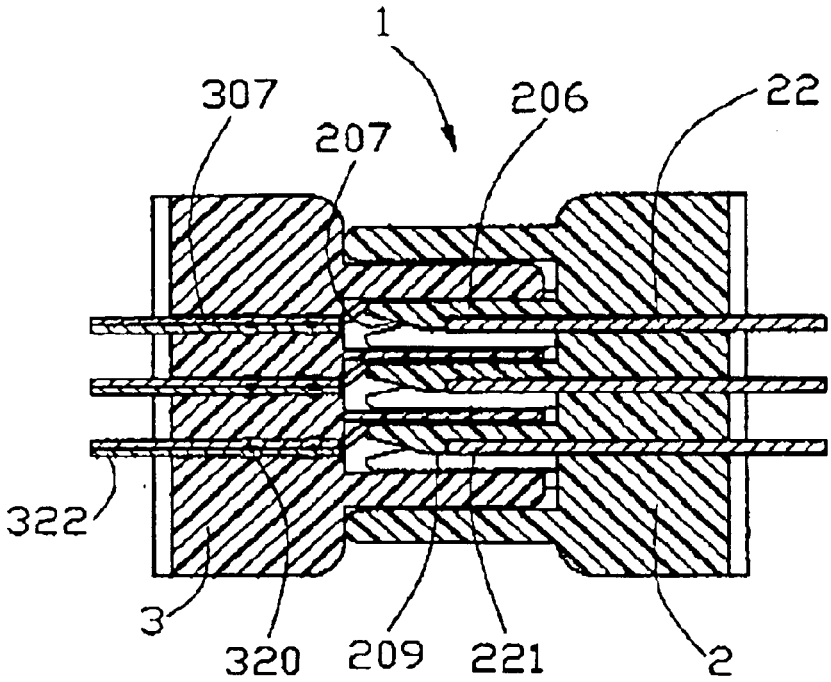
FIG. 19 is a cross-sectional view taken along line 19—19 of FIG. 17.
Figure 20:
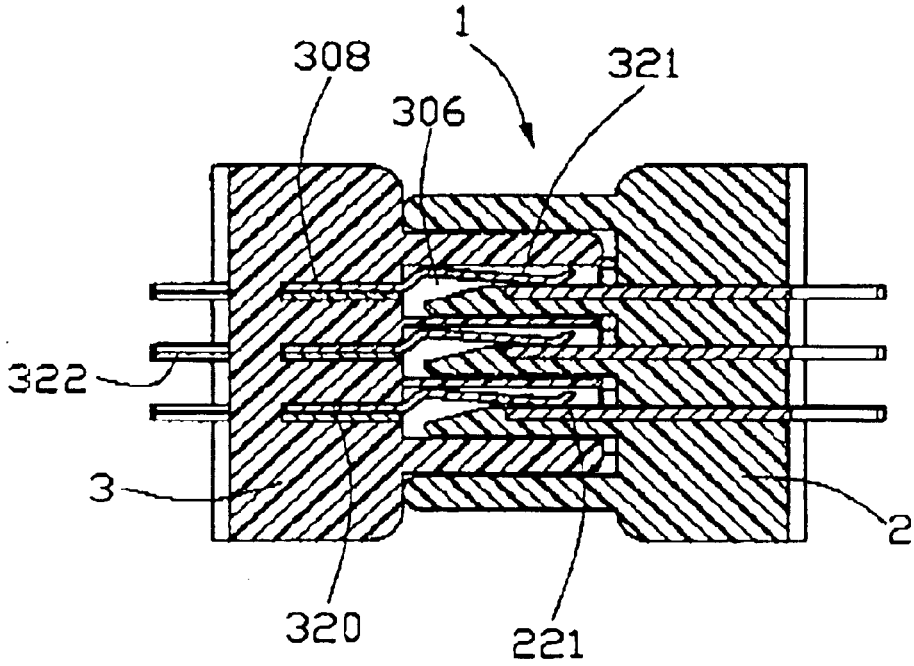
FIG. 20 is a cross-sectional view taken along line 20—20 of FIG. 17.
Figure 21:
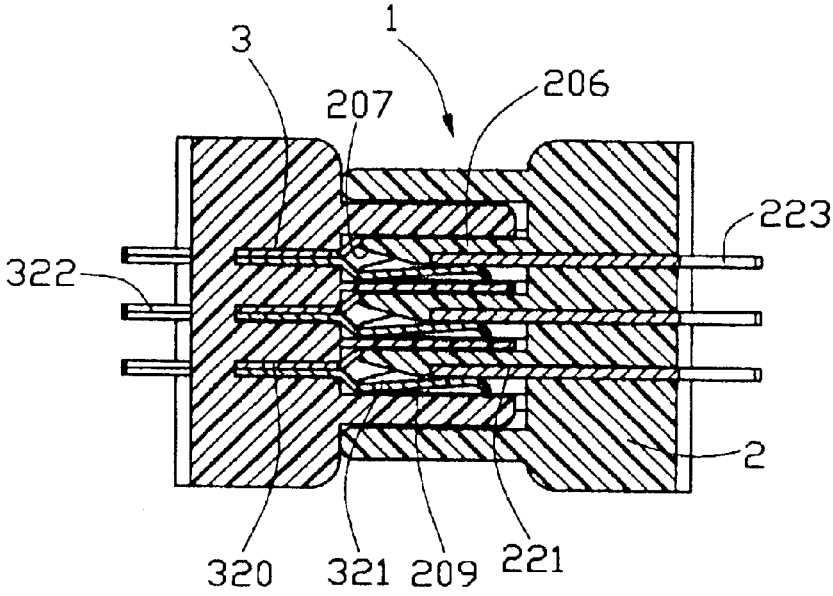
FIG. 21 is a cross-sectional view taken along line 21—21 of FIG. 17.
Figure 22:
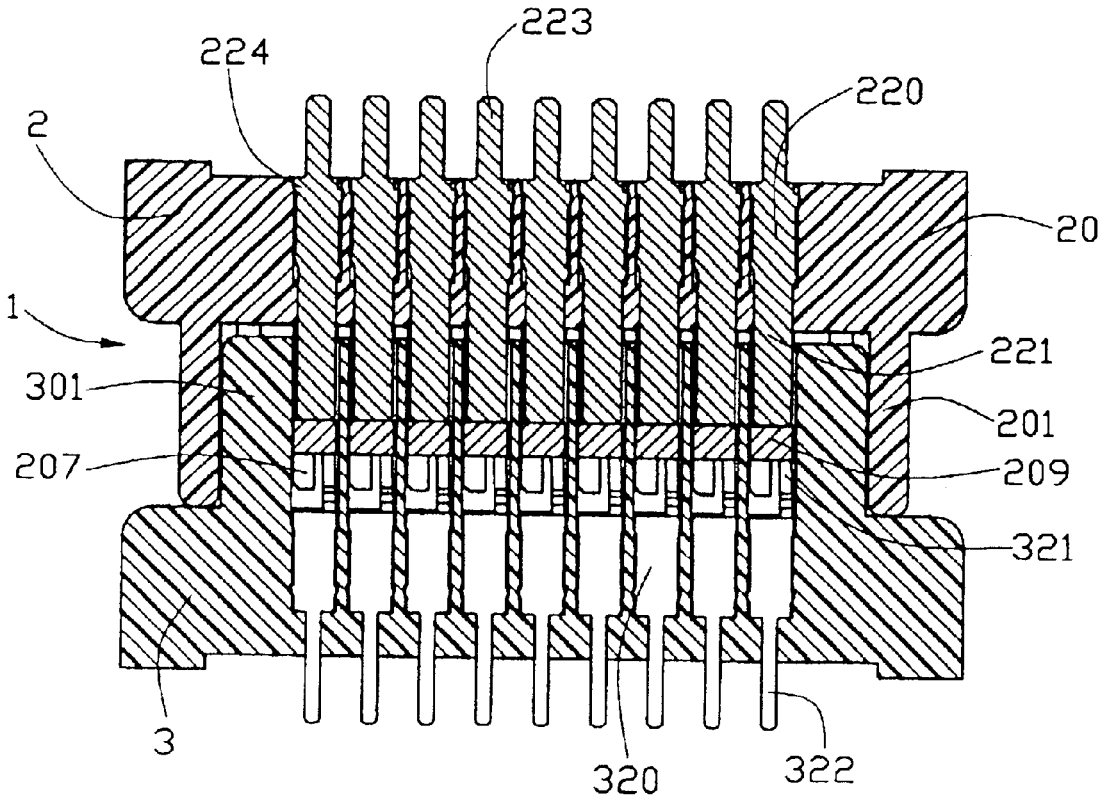
FIG. 22 is a cross-sectional view taken along line 22—22 of FIG. 18.
Figure 23:
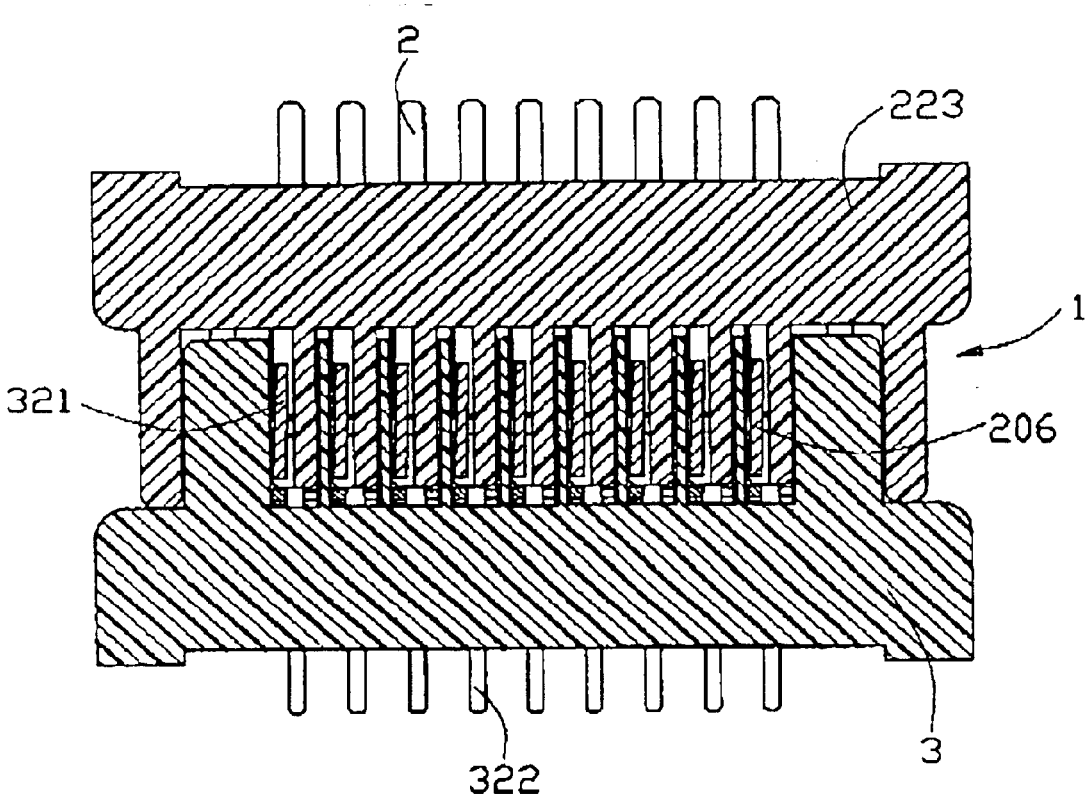
FIG. 23 is a cross-sectional view taken along line 23—23 of FIG. 18.
Figure 24:
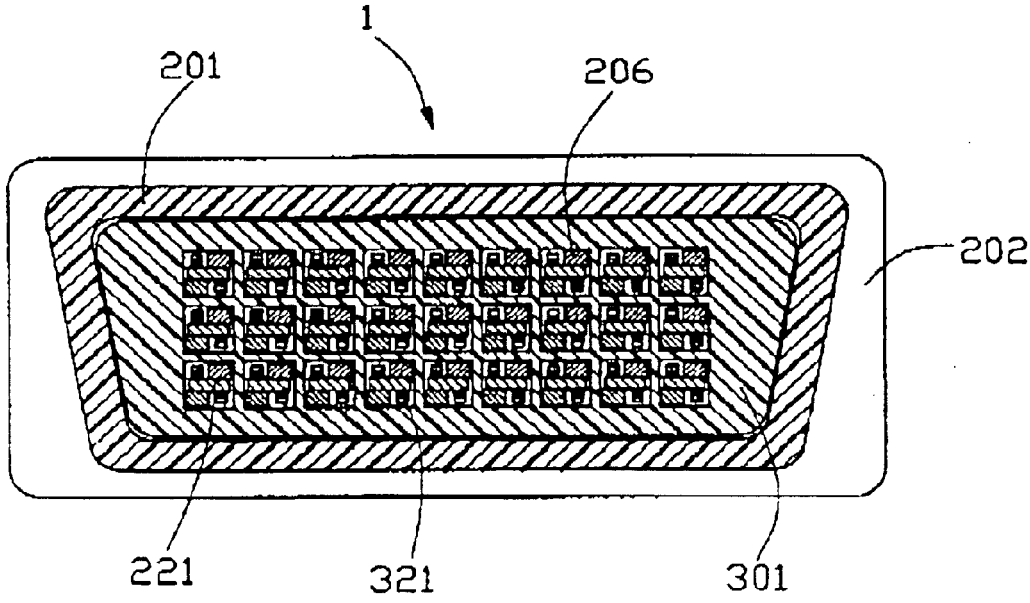
FIG. 24 is a cross-sectional view taken along line 24—24 of FIG. 17.

The plug connector 2 comprises an insulative housing 20 and a plurality of electrical contacts 22. The insulative housing 20 comprises a rectangular base portion 200 and a D-shaped mating portion 201. The base portion 200 comprises a mating face 202, an engaging face 203 opposite to the mating face 202 and a pair of supporting sections 204 extending from two opposite ends thereof beyond the engaging face 203. The base portion 200 defines a plurality of passageways 205 extending through the mating face 202 and the engaging face 203. Referring also to FIG. 14, each passageway 205 comprises a retention section 211 extending from the engaging face 203 toward the mating face 202 and having a diameter/dimension relatively larger than the rest sections of the passageway 205.

The mating portion 201 extends forwardly from the mating face 202 of the base portion 200 and defines a receiving cavity 208 in communication with the passageways 205. A plurality of fingers 206 extend forwardly from the mating face 202 of the base portion 200 into the receiving cavity 208 of the mating portion 201. Each finger 206 defines an inclined guiding face 207 at a forward free end thereof, a contact face 209 extending rearwardly from the guiding face 207 and a cutout 210 recessed from the contact face 209. Every two adjacent fingers 206 are vertically and laterally offset from each other in such a way that the cutouts 210 thereof communicating with each other and commonly communicating with one corresponding passageway 205. The guiding face 207 of one of every two adjacent fingers 206 faces upwardly while the guiding face 207 of the other of every two adjacent fingers 206 faces downwardly.

The electrical contacts 22 are generally planar and each comprises a retention portion 220, a contact portion 221 extending forwardly from the retention portion 220, and a tail portion 223 extending rearwardly from the retention portion 220. The retention portion 220 comprises a plurality of barbs 224 extending outwardly from two opposite sides thereof. The retention portion 220 is constructed to have a width thereof relatively larger than the contact and the tail portions 221, 223 and correspond in the dimension thereof to the retention section 211 of the passageway 205 of the base portion 200.

Figure 3:
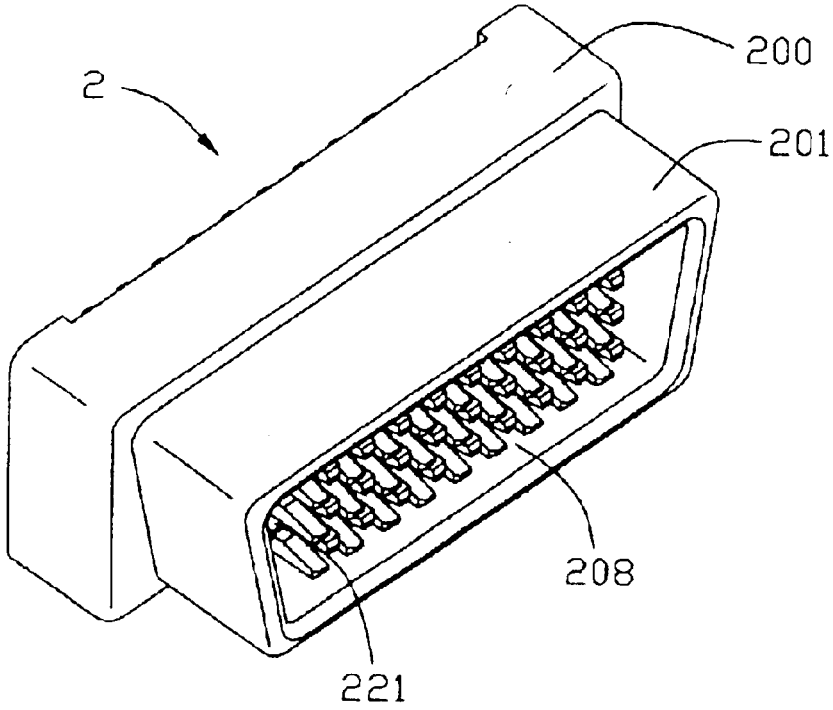
FIG. 3 is an assembled perspective view of a plug connector of the electrical connector assembly of FIG. 1.
Figure 4:
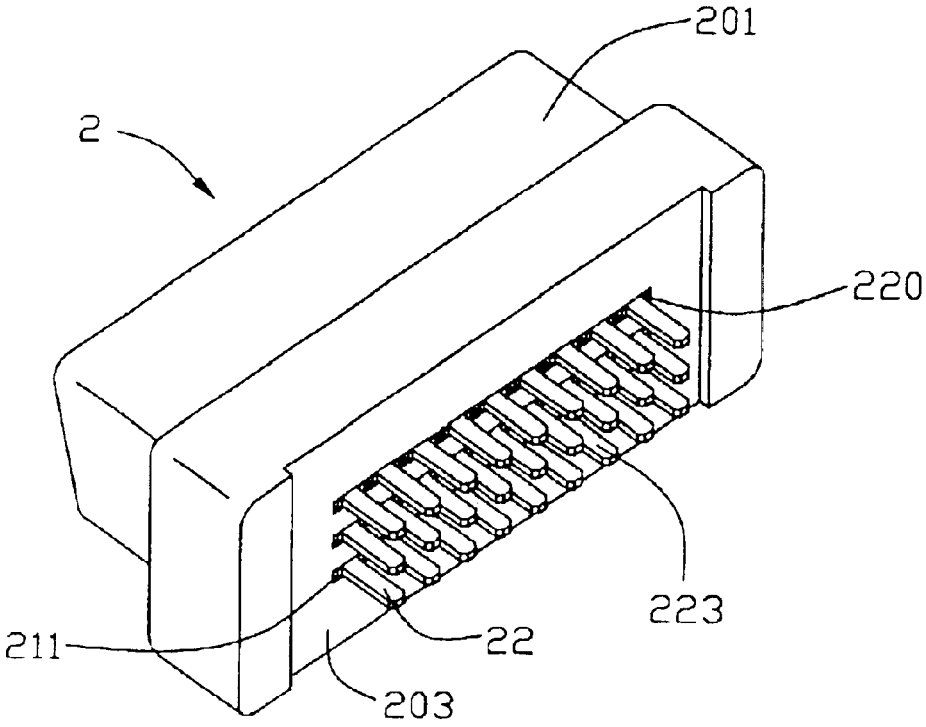
FIG. 4 is a view similar to FIG. 3 but taken from a different perspective.
Figure 5:
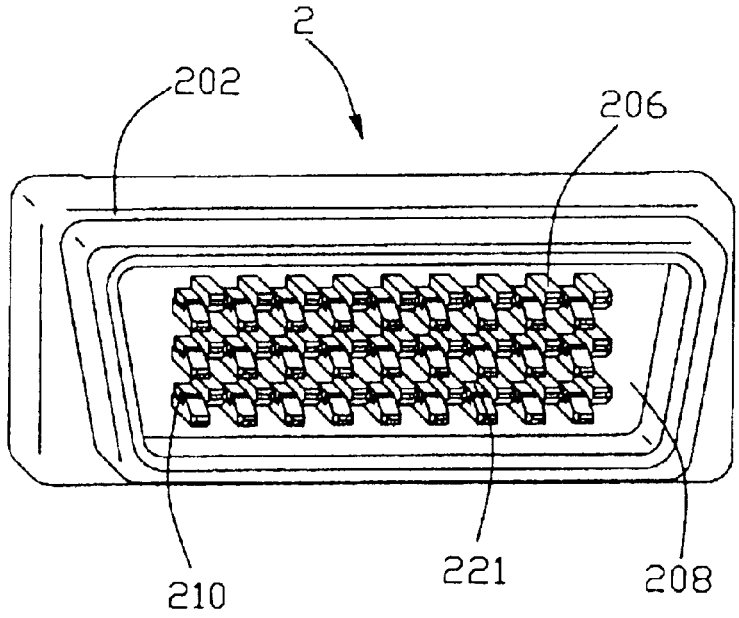
FIG. 5 is a view similar to FIG. 3 but taken from a different perspective.
Figure 6:
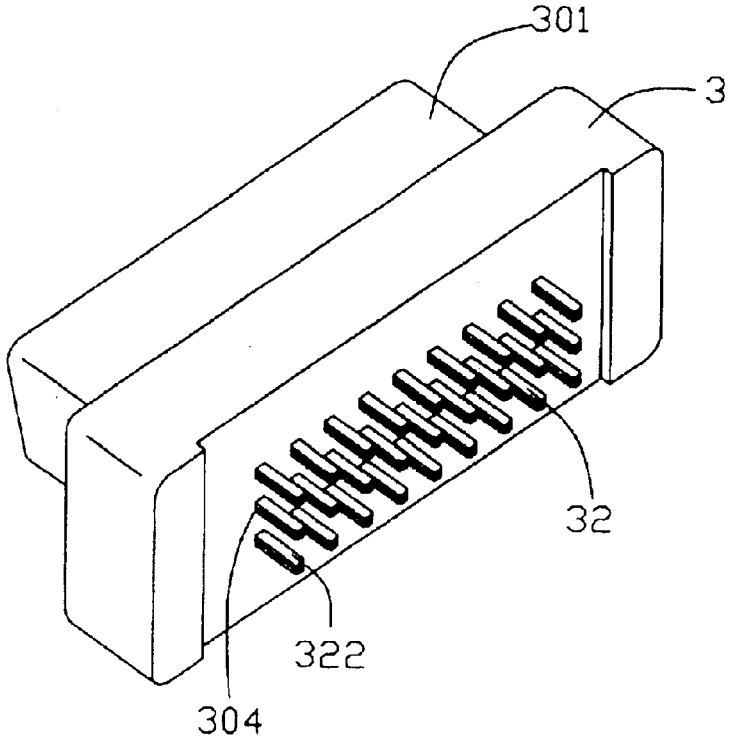
FIG. 6 is an assembled perspective view of a receptacle connector of FIG. 1.
Figure 7:
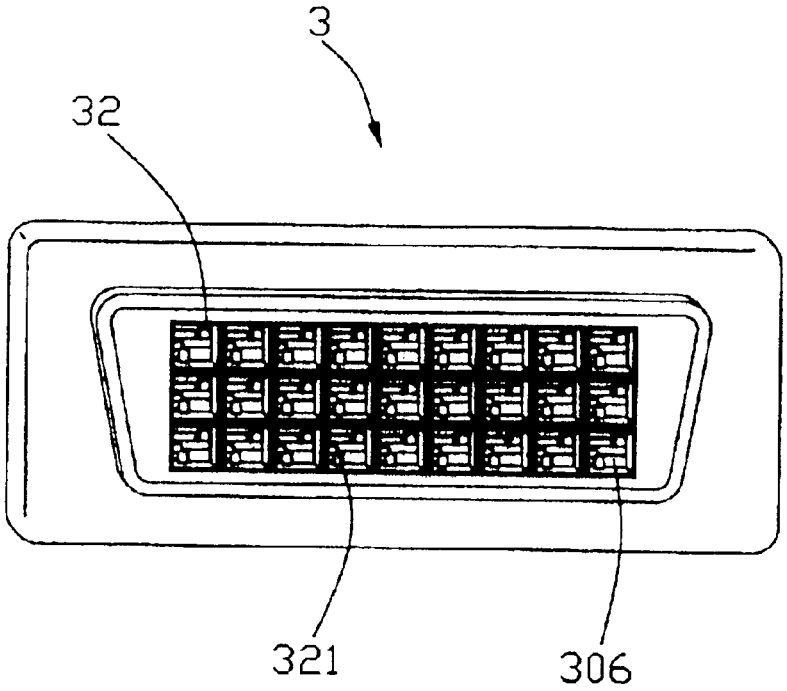
FIG. 7 is a view similar to FIG. 6 but taken from a different perspective.
Figure 8:
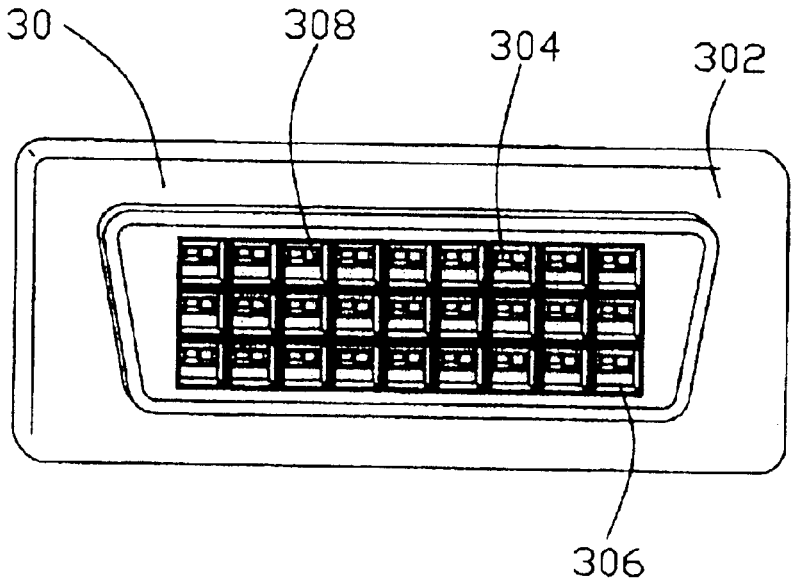
FIG. 8 is a perspective view of an insulative housing of the receptacle connector of FIG. 6.
Figure 9:
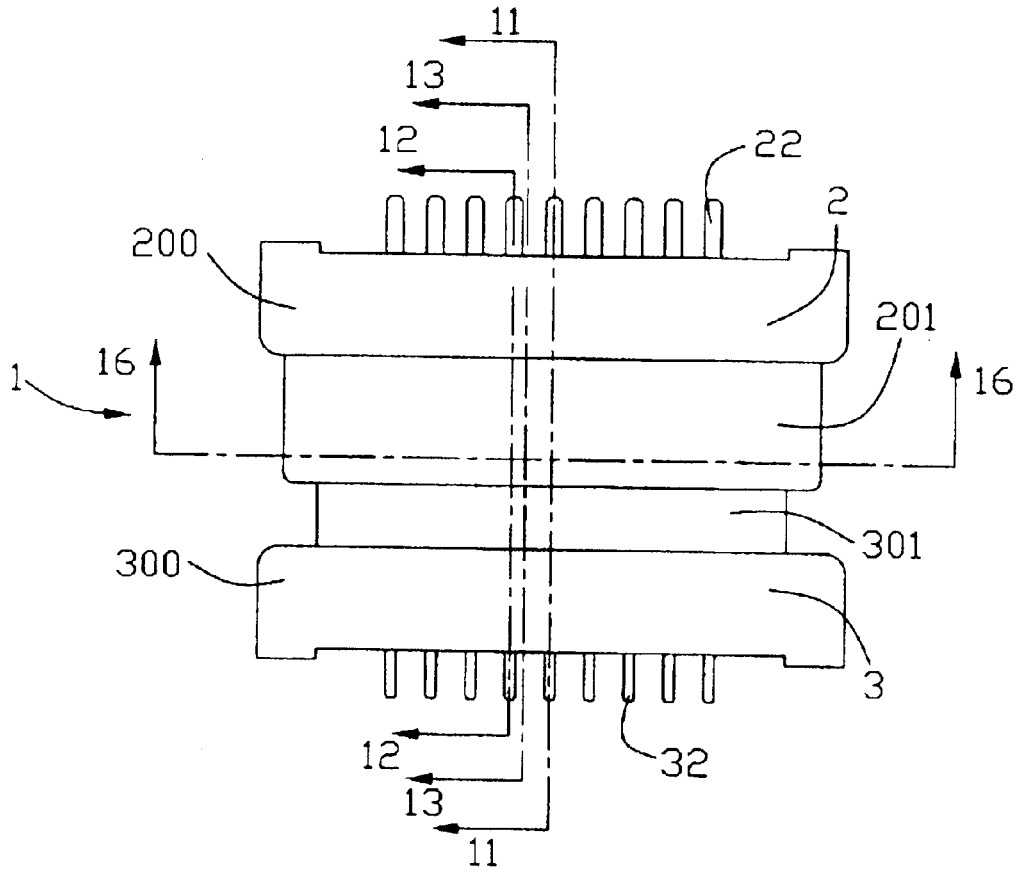
FIG. 9 is a top plan view of the electrical connector assembly of FIG. 1 before the plug connector and the receptacle connector thereof are completely mated with each other.
Figure 10:
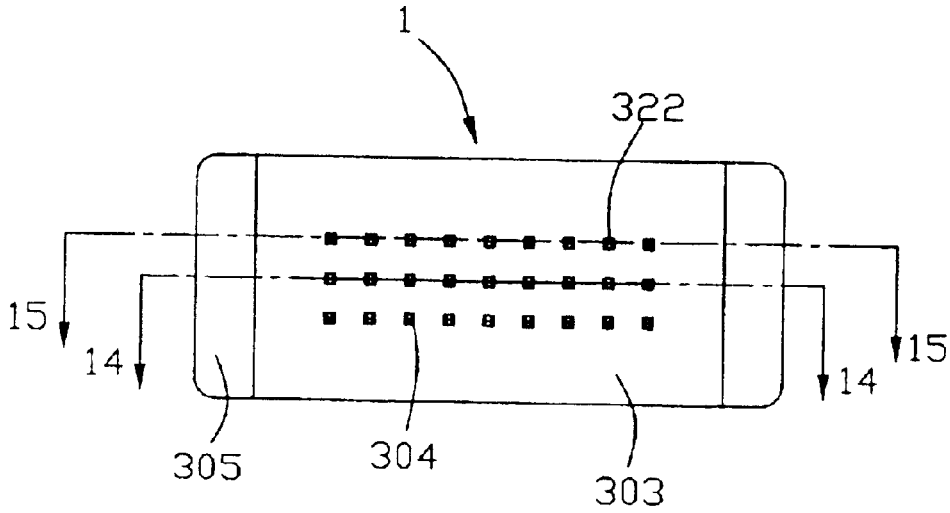
FIG. 10 is a front elevational view of FIG. 9.
Figure 11:
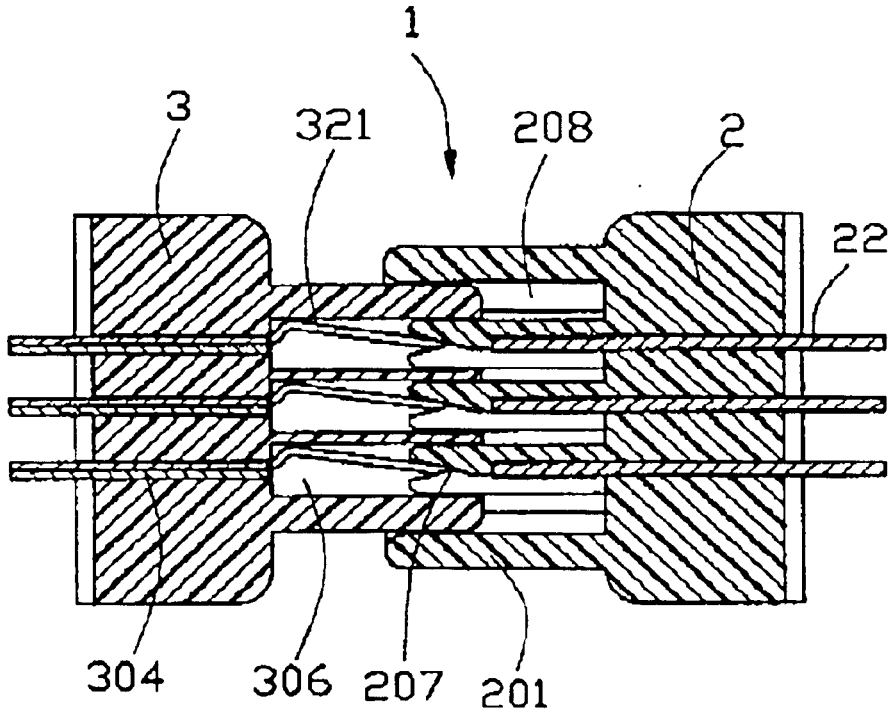
FIG. 11 is a cross-sectional view taken along line 11—11 of FIG. 9.
Figure 12:
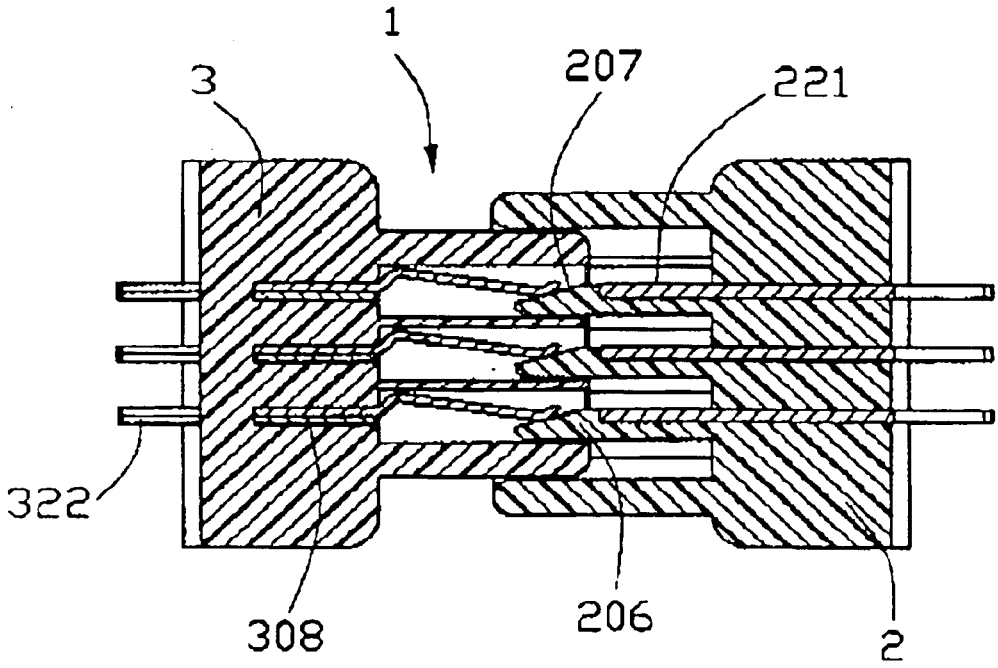
FIG. 12 is a cross-sectional view taken along line 12—12 of FIG. 9.
Figure 13:
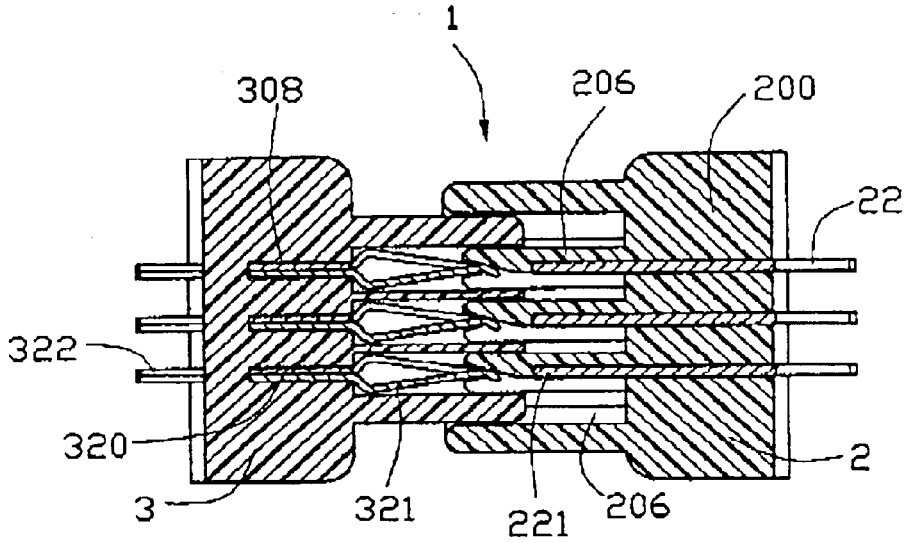
FIG. 13 is a cross-sectional view taken along line 13—13 of FIG. 9.

Referring also to FIGS. 3, 4 and 5, in assembly, the electrical contacts 22 are inserted from the engaging face 203 into the insulative housing 20 of the plug connector 2. The retention portions 220 are retained in the retention sections 211 by means of the engagement of the barbs 224 thereof and base portion 200. The contact portions 221 extend into the receiving cavity 208 of the mating portion 201. Each contact portion 221 is accommodated by the cutouts 210 of two adjacent fingers 206 to be supported by the two adjacent fingers 206. The tail portions 223 are located outside of the engaging face 203.

The receptacle connector 3 comprises an insulative housing 30 and a plurality of electrical contacts 32. The insulative housing 30 comprises a rectangular base portion 300 and a D-shaped mating portion 301. The base portion 300 comprises a mating face 302, an engaging face 303 opposite to the mating face 302, a plurality of passageways 304 extending through the mating face 302 and the engaging face 303, and a pair of supporting sections 305 extending from two opposite ends thereof beyond the engaging face 303.

Referring also to FIGS. 8 and 11–14, each of the passageways 304 comprises a receiving section 308 extending from the mating face 302 toward but not to the engaging face 303 and having a dimension/diameter larger than the rest sections of the passageway 304.

The mating portion 301 extends forwardly from the mating face 302 of the base portion 300 and comprises a plurality of grooves 306 extending therethrough. Each groove 306 communicates with a corresponding passageway 304 to construct a receiving channel 307 of the insulative housing 30. The grooves 306 are generally rectangular. Each groove 306 is larger in the height thereof than a corresponding passageway 304 and communicates with the corresponding passageway 304.

Each of the electrical contacts 32 comprises a retention portion 320, a resilient arm 321 extending forwardly from a front end of the retention portion 320 and a tail portion 322 extending rearwardly from a rear end of the retention portion 320. The retention portion 320 has a width larger than the resilient arm 321 and the tail portion 322. The resilient arm 322 has a center line thereof along the longitudinal direction of the electrical contact 32 offsetting from a longitudinal center line of the tail portion 322, which extends from a middle of the width of the retention portion 320, i.e., the resilient arm 322 and the tail portion 323 are laterally offset from each other. The number of the electrical contacts 32 is twice of the number of the electrical contacts 22 and is twice of the number of the receiving channels 307 of the insulative housing 30. The number of the electrical contacts 32 is equal to the number of the fingers 206 of the insulative housing 20 of the plug connector 2.

Referring also to FIGS. 6–7 and 19–22, every two of the electrical contacts 32 of the receptacle connector 3 are arranged in such a way that the retention portions 320 thereof and the tail portions 322 thereof respectively abut against each other in a face to face fashion and the resilient arms 321 thereof laterally offset from each other in a vertical opposing manner. The two electrical contacts 32 are inserted from one of the grooves 306 of the mating portion 301 through a corresponding passageway 304 of the base portion 300 to be accommodated in the receiving channel 307 of the insulative housing 30 of the receptacle connector 3.

The retention portions 320 are retained in the receiving sections 308 of the passageways 304 of the base portion 300 while the tail portions 322 partially extend beyond the engaging face 303 of the base portion 300 and the resilient arms 321 extend resiliently in the grooves 306 of the mating portion 301. The resilient arms 321 in each groove 306 are laterally offset from each other and one resilient arm 321 of the two electrical contacts 32 extends slantedly upwardly in the groove 306 while the other resilient arm 321 of the two electrical contacts 32 extends slantedly downwardly in the groove 306.

Referring also to FIGS. 9–16, during the course of mating the plug connector 2 with the receptacle connector 3, the mating portion 301 of the receptacle connector 3 is plugged into the receiving cavity 208 of the mating portion 201 of the plug connector 2. Each pair of adjacent fingers 206 with the contact portion 222 of the electrical contact 22 therein protrude into one groove 306 with the guiding faces 207 thereof guiding the resilient arms 321 in the groove 306 with a lower force. A force needed to mate the electrical contacts 22 with the electrical contacts 32 in the grooves 306, i.e., the force needed to insert the mating portion 301 into the receiving cavity 208, increases with the further relative movement of the fingers 206 and the resilient arms 321 due to the slanted configurations of the fingers 206 and the resilient arms 321. Therefore, a total force, i.e., the insertion force, needed to mate the plug connector 2 and the receptacle connector 3 is reduced compared to conventional electrical connectors (not shown) having electrical contacts and/or housings thereof without slanted configurations.

Referring also to FIGS. 17–24, when the plug connector 2 and the receptacle connector 3 are completely/finally mated with each other, a front end of the mating portion 201 abuts against the mating face 302. The resilient arms 322 have already passed through the guiding and the contact faces 207, 209 and reached to electrically contact with the contact portions 221 of the electrical contacts 22.

The electrical contacts 32 of the receptacle connector 3 are formed with simple structures, thereby simplifying the manufacturing process thereof. In addition, the electrical contacts 22, 32 all can be provided on a carrier strip spaced apart by centerline spacings adapted for ready insertion in a connector housing in single stamping operation, thereby simplifying the assembly process of the electrical connector assembly 1 and reducing the cost of the electrical connector assembly 1.

The insulative housing 20 has the fingers 206 constructed respectively corresponding to the resilient arms 321 of the electrical contacts 32 in each groove 306 to insert the contact portions 221 into between the two resilient arms 321 without wiping against the precious metal plated on the resilient arms 321, thereby ensuring the long-term reliability of the electrical connection between the plug and the receptacle connectors 2, 3 and further reducing the cost of the electrical connector assembly 1.

The electrical contacts 22 have no twisted structures therein, thereby having no dimension limitation in miniaturization.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a first connector comprising a first insulative housing and a plurality of first electrical contacts each comprising a resilient arm arranged in pairs; and a second connector comprising a second insulative housing and a plurality of second electrical contacts each comprising a contact portion, the second insulative housing comprising a base portion retaining the second electrical contacts, a mating portion extending from the base portion and defining a receiving cavity, and a plurality of fingers arranged in laterally offset pairs extending from the base portion into the receiving cavity, each pair of fingers accommodating the contact portion of one of the second electrical contacts therein and guiding the resilient arms of the corresponding pair of the first electrical contacts to electrically contact with the contact portion of one of the second electrical contacts.

2. The electrical connector assembly as claimed in claim 1, wherein the base portion of the second insulative housing defines a mating face, an engaging face opposite to the mating face and a plurality of passageways extending through the mating and the engaging faces, the second electrical contacts being inserted from the engaging face into the passageways.

3. The electrical connector assembly as claimed in claim 2, wherein each of the passageways comprises a retention section extending from the engaging face toward the mating face and wherein each of the second electrical contacts comprises a retention portion accommodated in the retention section.

4. The electrical connector assembly as claimed in claim 2, wherein each of the fingers of the second connector defines a cutout in communication with the passageway to receive the contact portion of the second electrical contact therein.

5. The electrical connector assembly as claimed in claim 1, wherein the resilient arms of the first electrical contacts are slanted and wherein each of the fingers of the second connector defines an inclined guiding face corresponding to the resilient arms.

6. An electrical connector comprising:

an insulative housing comprising a mating portion defining a receiving cavity and a plurality of insulating fingers extending in the receiving cavity, the fingers being arranged in pairs and the corresponding two finger of each pair being laterally offset from each other; and a plurality of electrical contacts each comprising a retention portion retained in the insulative housing, a tail portion extending rearwardly beyond the insulative housing, and a contact portion extending into the receiving cavity and supported by the corresponding two fingers of one pair in opposite directions perpendicular to the contact portion.

7. The electrical connector as claimed in claim 6, wherein the number of the fingers is twice of that of the electrical contacts.

8. The electrical connector as claimed in claim 6, wherein the insulative housing comprises a base portion and wherein the mating portion and the fingers extend from the base portion.

9. The electrical connector as claimed in claim 8, wherein the base portion defines a mating face from which the mating portion and the fingers extend, an engaging face opposite to the mating face, and a plurality of passageways extending through the mating face and the engaging face.

10. The electrical connector as claimed in claim 9, wherein each of the fingers defines a cutout in communication with one corresponding passageway to receive the contact portion of one corresponding electrical contact.

11. The electrical connector as claimed in claim 9, wherein each of the fingers defines a cutout therein and wherein the cutouts of every two adjacent fingers commonly communicate with one corresponding passageway to commonly receive the contact portion of one corresponding electrical contact therein.

12. The electrical connector as claimed in claim 10, wherein each of the fingers defines an inclined guiding face extending forwardly of the cutout thereof.

* * * * *